United States Patent [19]

Funk

[11] 4,317,299

[45] Mar. 2, 1982

[54] TOOTH ARRANGEMENT FOR EARTHWORKING IMPLEMENT

[75] Inventor: Francis C. Funk, Dubuque, Iowa

[73] Assignee: Deere & Company, Moline, Ill.

[21] Appl. No.: 164,113

[22] Filed: Jun. 30, 1980

[51] Int. Cl.[3] ..... E02F 9/28

[52] U.S. Cl. ..... 37/141 T

[58] Field of Search ..... 37/141 T, 141 R, 142 R

[56] References Cited

U.S. PATENT DOCUMENTS

| | | | |
|---|---|---|---|
| 7,252 | 4/1850 | Sweet | 37/141 T X |
| 1,233,574 | 7/1917 | Hemme | 37/141 R |
| 1,540,314 | 6/1925 | Clark | 37/141 T |
| 3,851,413 | 12/1974 | Lukavich | 37/141 T |
| 4,127,952 | 12/1978 | Chamberlain | 37/141 R |

*Primary Examiner*—Clifford D. Crowder

[57] ABSTRACT

An earth-working implement in the form of a loader bucket includes a set of primary teeth which operate to fracture and lift earth being loaded in the bucket. Mounted between each adjacent pair of primary teeth is a secondary tooth which is shaped to operate on any ridges of earth left between the primary teeth such as to divide and urge the ridges outwardly toward voids left by the primary teeth.

2 Claims, 3 Drawing Figures

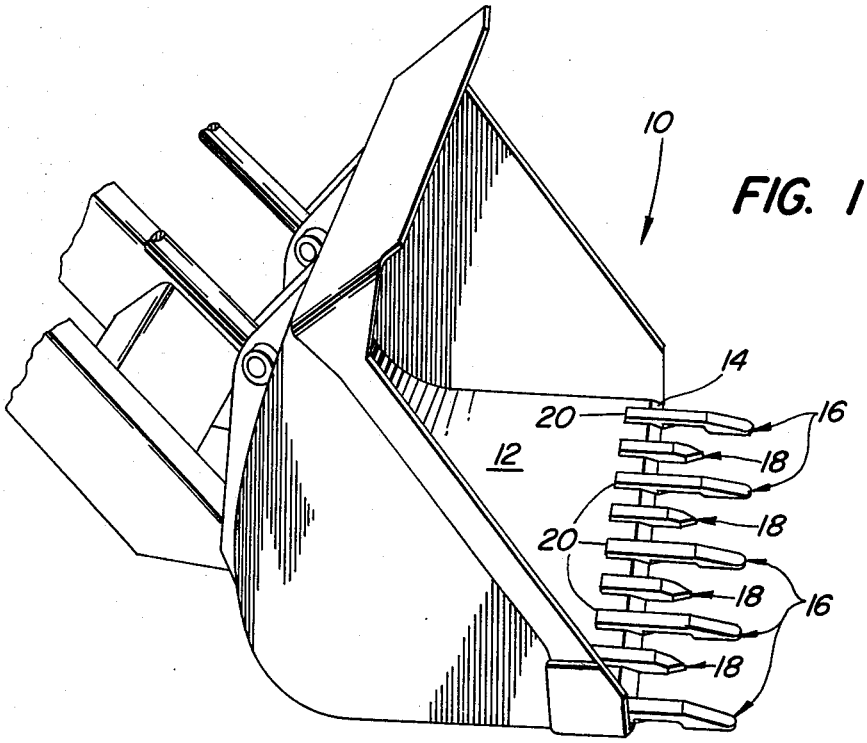
FIG. 1
FIG. 2
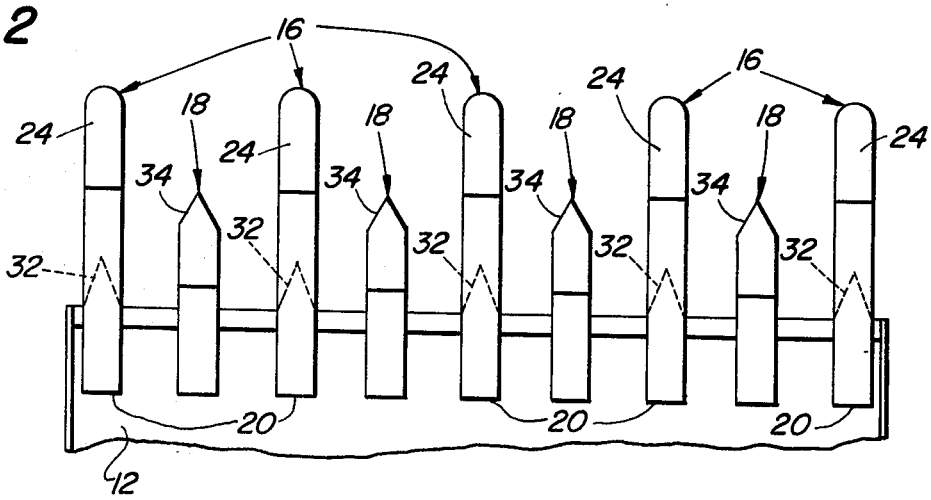
FIG. 3
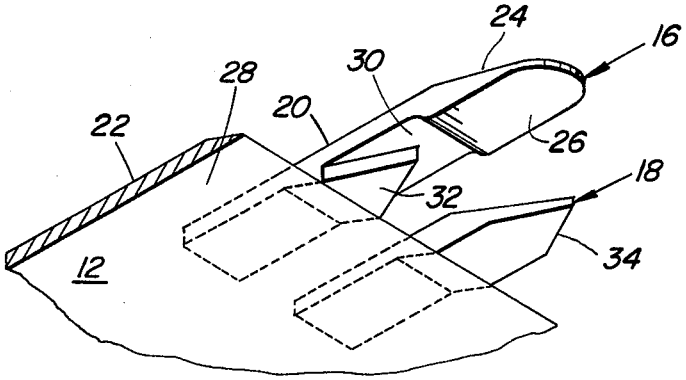

TOOTH ARRANGEMENT FOR EARTHWORKING IMPLEMENT

BACKGROUND OF THE INVENTION

The present invention relates to earthworking implements and more specifically relates to earth-engaging teeth for earth-working implements designed for loading material.

It is known in the art to mount teeth at equispaced locations across the length of cutting blades for earth-working implements, such as loader buckets and scraper bowls, for the purpose of fracturing material ahead of the blades so as to reduce the power required for loading the material. However, in some materials such as soils having a high clay content for example, such fracturing is localized to respective zones which are not much wider than an individual tooth thus resulting in the cutting blade encountering earth which has not been fractured or otherwise loosened. Thus the power requirement for loading such material is relatively high.

SUMMARY OF THE INVENTION

According to the present invention, there is provided an improved tooth arrangement for an earth-working implement of the earth loading type.

An object of the invention is to provide an earth-working implement of the earth loading type with a tooth arrangement which reduces the power required for loading earth of a certain consistency.

A more specific object is to provide an earth-working implement with a primary set of teeth for fracturing and elevating earth and a secondary set of teeth for fracturing and moving earth sideways into voids left by the primary teeth.

Yet another object is to provide primary teeth as set forth in the immediately preceding object which includes rearward tooth portions which operate to remove the loose material moved into These and other objects will become apparent from a reading of the ensuing description together with the appended drawing.

BRIEF DESCRIPTION OF THE DRAWING

FIG. 1 is a right front perspective view of an earth-working bucket having teeth arranged in accordance with the invention.

FIG. 2 is a top plan view of the tooth arrangement of FIG. 1.

FIG. 3 is a perspective view of the underside of adjacent ones of the primary and secondary sets of teeth.

DESCRIPTION OF THE PREFERRED EMBODIMENT

Referring now to FIG. 1 the drawing, therein is shown a loader bucket 10 having a transverse, flat cutting blade 12 including a forward beveled edge forming a cutting edge 14.

A plurality of laterally spaced primary earth-working teeth 16 are secured to the cutting edge and respectively interposed between each adjacent pair of the teeth 16 is a secondary earth-working tooth 18.

The teeth 16 each include an elongate shank 20 which projects forwardly beyond the blade 12 at a level commensurate with the level of a top surface 22 of the blade. As can best be seen in FIG. 3, integral with the forward end of each shank 20 is a forward earth-lifting blade portion 24 which is wedge-shaped in side view and includes a bottom surface or sole 26 which is coplanar with a bottom surface 28 of the blade. The rear of the tooth portion 24 is spaced forwardly of the cutting blade 12 and thus a gap 30 is defined between the blade and the tooth portion. Each tooth 16 further includes a rearward tooth portion 32 located in the gap 30 in rearwardly spaced relationship to the forward tooth portion 24. The tooth portions 32 are each wedge-shaped in plan view for a purpose to be described hereinbelow.

The secondary earth-working teeth 18 each include an earth-dividing portion 34 which is wedge-shaped in top plan view, is disposed generally at the same level as the forward tooth portions 24 of the primary teeth 16 and is located beside those portions of adjacent ones of the gaps 30 which are not occupied by adjacent ones of the rearward tooth portions 32.

The operation of the invention is as follows. Assuming that the bucket 10 is being used in an operation where relatively thin "slices" of earth are being removed so as to bring the ground level down to some predetermined grade, the forward earth-lifting portions 24 of the primary teeth 16 will act to fracture and elevate the earth so that it slides over the top of the blade 12. If the earth is of a composition which results in unfractured earth being left at opposite sides of the tooth portions 24, the earth-dividing portions 34 of the secondary teeth 18 will engage the unfractured earth and push it sideways towards respective voids formed by the passage of the forward portions 24 of the primary teeth 16. Some of the earth operated on by the secondary teeth will pass over the blade 12 while some will be pushed into the voids left by the passage of the forward portions 24 of the primary teeth. The earth which is pushed into the voids by the secondary teeth is pushed out by the rearward tooth portions 32 of the primary teeth and pass over the blade 12.

Thus, it will be appreciated that the primary teeth act to leave ridges of material therebetween which lack lateral support and that the secondary teeth take advantage of this lack of lateral support by engaging the ridges with a wedge shape which acts to push the material sideways.

I claim:

1. In an earth-working tool having an elongate cutting blade provided with a leading cutting edge and a plurality of teeth secured to the blade and projecting forwardly of the cutting edge, the teeth being of an improved arrangement comprising: a plurality of equispaced primary and secondary teeth arranged in alternating fashion across the cutting blade with adjacent ones of the primary and secondary teeth being spaced from each other so as to leave spaced sections of the blade which are free of teeth; said primary teeth including forward digging portions which are generally wedge-shaped in side view whereby they act to lift material and are located forwardly of the secondary teeth; and said secondary teeth including forward digging portions which are generally wedge-shaped in plan view whereby they move soil sideways into voids created by the primary teeth.

2. The earth-working tool defined in claim 1 wherein the forward digging portions of the primary teeth includes a sole portion which is substantially co-planar with a bottom surface of the cutting blade; said forward digging portion of the primary teeth being joined to the cutting blade by a shank elevated above the plane of the blade bottom surface to thereby create a gap between the forward digging portion of the primary teeth and the blade; and said primary teeth including rearward earth-moving portions disposed at least partially behind the forward digging portions of the secondary teeth and being substantially wedge-shaped in plan view.

* * * * *